United States Patent [19]

Swithenbank et al.

[11] 4,348,169

[45] Sep. 7, 1982

[54] CONTROL OF BURNERS

[75] Inventors: Joshua Swithenbank; David S. Taylor, both of Sheffield, England

[73] Assignee: Land Combustion Limited, Chesterfield, England

[21] Appl. No.: 37,690

[22] Filed: May 10, 1979

[30] Foreign Application Priority Data

May 24, 1978 [GB] United Kingdom ..... 22180/78

[51] Int. Cl.[3] ..... F23N 5/08; F23N 5/10

[52] U.S. Cl. ..... 431/89; 431/12; 431/24

[58] Field of Search ..... 431/24, 12, 73, 67, 431/89, 90

[56] References Cited

U.S. PATENT DOCUMENTS

| | | | |
|---|---|---|---|
| 3,684,423 | 8/1972 | Bryant | 431/24 |
| 4,032,285 | 6/1977 | Rohr | 431/90 |
| 4,043,742 | 8/1977 | Egan | 431/12 |
| 4,050,878 | 9/1977 | Priegel | 431/90 |
| 4,059,385 | 11/1977 | Gulitz | 431/90 |
| 4,144,997 | 3/1979 | Anderson | 431/90 |

*Primary Examiner*—George E. Lowrance

*Attorney, Agent, or Firm*—Trexler, Wolters, Bushnell & Fosse, Ltd.

[57] ABSTRACT

The invention relates to the control of burners, e.g., for boilers or furnaces and has for its objective to provide means whereby the combustion conditions existing at a burner are initially governed by pre-determined conditions which conditions can be automatically maintained or improved during the operation of the burner. This objective is met by the provision of control means for the reactant flow ratio for at least one burner comprising separate valve means for the control of flow of fuel and of air to a burner, a variator associated with each valve for the setting of the position thereof, sensing means associated with each valve for the sensing of the position thereof, a memory device for holding data pertaining to the characteristics of the control means, a computing device for controlling the variators to determine the positions of the valves in accordance with data in the memory device and detector means associated with the or each burner for the detection of a pre-determined parameter of combustion, both said sensing and detector means being connected to the memory device and whereby the data in the memory device can be continuously up-dated and whereby the computing means can optimize the performance of the control means on the basis of the feed-back of information from the said detector means and sensing means.

13 Claims, 1 Drawing Figure

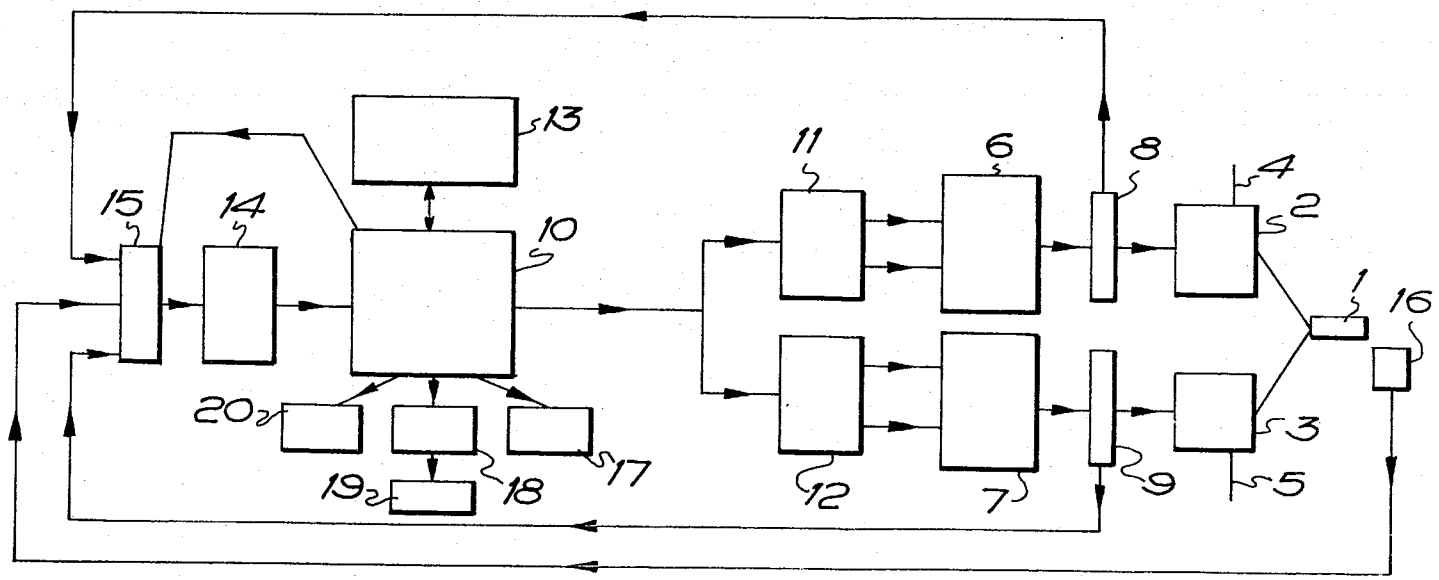
16
1
4
2
3
5
8
9
6
7
11
12
13
10
17
18
19
20
14
15

CONTROL OF BURNERS

This invention relates to the control of burners, e.g., for boilers or furnaces.

During the continuous operation of a boiler or furnace, it is frequently the case that because of variations to a greater or lesser degree of the supply of both fuel and air to the burner or changing conditions in the boiler or furnace, the or each burner does not operate at optimum efficiency for a required output. At the time of starting up of a boiler or furnace theoretical calculation is normally employed as a means of determining the degree to which the fuel valve and air valve in the supply line to the burner are opened, and it is equally frequently the case that because of the conditions within the boiler or furnace the theoretical determination of the respective positions does not in fact produce conditions at the burner that meet the pre-determined requirements.

It is therefore the object of the present invention to provide means whereby at the start up of a boiler or furnace, the or each burner will have combustion conditions governed by pre-determined considerations, and that during operation of the burner the control means provide automatic insurance of predetermined combustion conditions in the or each burner.

According to the present invention, control means for the reactant flow ratio for at least one burner comprises separate valve means for the control of flow of fuel and of air to a burner, a variator associated with each valve for the setting of the position thereof, sensing means associated with each valve for the sensing of the position thereof, a memory device for holding data pertaining to the characteristics of the control means, a computing device for controlling the variators to determine the positions of the valves in accordance with data in the memory device and detector means associated with the or each burner for the detection of a pre-determined parameter of combustion, both said sensing and detector means being connected to the memory device and whereby the data in the memory device can be continuously up-dated and whereby the computing means can optimise the performance of the control means on the basis of the feed-back of information from the said detector means and sensing means.

In practice, burners are located within boilers or furnaces in a number of ways. Thus, there are instances where a boiler or furnace has a single burner and which would have its own control means in accordance with the invention, in other instances a number of individually controlled burners can be provided within a boiler or furnace, and when each burner would have its own control means in accordance with the invention, and there are still further instances where a number of burners are provided within a boiler or furnace on a common ring mains, and when the control means of the invention would control the supply of fuel and air to the ring mains. Dependent upon the type of computing device and memory device employed it is equally possible within the invention to employ one computing device and memory device to control separately a number of burners whether within one boiler or within a number of boilers.

In addition to providing continuous control over the fuel valve and air valve, it is highly desirable that the control means of the invention also incorporates an overall monitor/display system which can communicate with the or each individual controller so that the status of each individual burner control can be displayed and monitored at a centre point and so that overall control of each burner can be made from a central control panel.

An important aspect of the invention is that each individual controller of the invention is completely autonomous in respect of its operating capability so that in the event of one controller failing the other controllers in the same system are not affected, the or each burner associated with the failed controller being shutdown leaving all remaining burners operating normally. At the same time the failure of a particular controller is monitored and either a visual or audible signal provided at the monitoring panel. It is equally important that if some fault should occur in the overall monitoring system, each controller is able to continue operating normally thereby minimising the effect of failure of any one part of the whole system.

The single FIGURE is a block diagram of a burner control system constructed in accordance with the invention.

For simplicity reference will be made hereinafter to one control means in accordance with the invention controlling a single burner. Preferably the components of an individual control means in accordance with the invention consist of a microprocessor as the computer means, connected to a memory having a read-only and read-write facility. The read-only part of the memory will initially be fed with parameters determining the operating programme for the control means to be operative at the start-up of a burner, and which will run as soon as power is switched on. The read-write part of the memory preferably will contain a block of operating data capable of defining the acceptable positions of the fuel and air flows of the burner over the whole of its operating range. It is this block of data that is capable of being continuously up-dated so that changing conditions within a boiler or furnace can be reflected in changing values in the data stack thereby keeping the overall response characteristic of the control means of the invention at or near an optimum over the whole working range. The data in the stack can if desired represent a series of trios, i.e., representing sets of three valves related to air flow, fuel flow, and the measured feed-back value of a parameter of the flame at the burner. Alternatively the data in the stack may represent a series of spot values for the air flow corresponding to a full linear range of fuel flows. It would still further be possible for the data to represent a series of break points and gradients and whereby simple calculation would provide a derived value for the air valve position corresponding to any fuel flow.

It is preferred that the passing of information (initial parameters and up-dated parameters) to the memory of the microprocessor is via an analog digital convertor, itself preceded by an analog multiplexer. This combination enables one of a series of analog inputs to be selected and made available as an input to the microprocessor. Thus, there is allowed to be made the measurement of as many input parameters as are necessary to enable the normal functioning and control of the boiler. At the outset, there are three major parameters, boiler demand and the two valve positions determined theoretically as suiting that boiler demand. After the flame has been ignited, there would then be a feed-back parameter from the flame and possibly also a flame detector capable of giving a flame out signal. During the normal functioning of the burner, the demand boiler load setting may be in the form of an electrical potential derived from appropriate equipment serving to define the loading at which a boiler is required to operate. It could equally be a measurement in the form of a process measurement, e.g., such as steam pressure or temperature. The demand parameter on being fed to the microprocessor allows the computation of a position for, e.g., the fuel valve, the microprocessor then computing the accurate position for the air valve so that predetermined conditions are present at the burner. The valve positions are then themselves converted into parameters fed to the memory, e.g., by providing a slidewire associated with the motor shafts and energised with a known potential difference, the shaft position being picked-off by a wiper contact and that information fed into the memory. It is further possible to so arrange the potentials at the slidewire that in the event of breakage of a winding or the failure of a wiper contact a potential outside the normal range is fed through the analog digital converter to the microprocessor thereby enabling the microprocessor to detect that there is a fault condition in the system on comparison with the information in the memory. The feed-back parameter and flame detector parameter are preferably characterised by a varying electrical potential whose calibration factor relating to an actual value is known. Thus, if the conditions within a boiler change are such that the feed-back parameter shows a variation from the calibration factor, this is detected by the microprocessor and appropriate signals sent to the motors of the valves to adjust the valve position, and on receipt of a feed-back of a flame out signal the microprocessor closes down that burner.

As an alternative to the provision of, e.g. slidewire determination of the position of the valves, or indeed as an additional feature, the actual flow rates of both fuel and air can be constantly monitored and the flow rates used as a parameter in the control means to the invention. Thus, a flow transducer may be provided in each supply line (fuel and air) the output signal from which is fed to the multiplexer, and when the control means of the invention can react to an unpredictable change in the flow rate of either air or fuel and which would inevitably affect the combustion conditions at the burner to bring the burner back to the pre-determined condition. Thus, if there was a reduction or an increase in, e.g., the fuel flow rate, particularly the air valve and perhaps also the fuel valve can be altered in position to ensure that the required conditions at the burner are reinstated.

It is highly desirable that the control means of the invention has an ability to optimise the fuel/air ratio at the burner to suit a particular boiler demand. Thus, the microprocessor should embody means to allow limited variation of the fuel/air ratio and means for detecting the effect of such variations either on the basis of overall boiler performance or on the basis of a pre-determined parameter of the flame. Thus, the control means of the invention may allow a cyclic change to the fuel/air ratio by making, e.g., successive small increases and decreases in either or both of the fuel and air flows. The value of the feed-back parameter is monitored repeatedly by the microprocessor circuitry and allowing for possible transport lag and effect of a small change, a determination made as to whether or not that small change has been advantageous or disadvantageous. If the change is disadvantageous then the former positions are reverted to but if the small change has been advantageous then the new valve positions are fed back into the memory in such a way that the microprocessor is then fed with the new valve positions.

The invention, therefore, in its basic form, provides a highly efficient mode of control over a burner in a boiler or furnace enabling the burner to have initial operating conditions pre-determined by theoretical calculation related to boiler demand and equally importantly having a facility to continuously monitor the burner performance and make automatic adjustment of the fuel and air valves and whereby pre-determined conditions are maintained at a burner. It is desirable that the control means of the invention has other facilities. Thus, the microprocessor may be provided with output ports to provide signals to a local indicator panel which can give indications of failure of the slidewire or wiper at each motor, that the local controller has totally failed or that a flame out condition has occured. A further output port can be provided to send signals to a remote monitoring system where much the same information as on the local indicator panel can be provided. It is equally possible to provide a still further output port to feed information to a diagnostic system which can in turn facilitate the setting up of the system and have a fault diagnosis facility.

Bearing in mind that information stored in the memory associated with the memory of the control means can have been built up over a considerable period of boiler operation, it is advisable to guard against the possibility of a fault developing in the system which has the effect of erasing the data from the memory. It is therefore further preferred that information stored in the data stack of the memory of the control means is transferred to a main memory at the remote monitoring system. In the event of the memory of the controller being wiped clean, the information stored at the remote monitoring system can then be fed back to that memory once the fault has been rectified.

One embodiment of the invention will now be described by way of example only with reference to the accompanying block diagram which shows control means in accordance with the invention controlling a single burner.

In the diagram, a burner 1 is shown connected to two valves 2 (fuel) and 3 (air), with each valve in supply lines 4 and 5 for fuel and air respectively. The fuel valve 2 is connected to a motor 6 and the air valve 3 connected to a motor 7, the motors 6, 7 having mounted on their respective drive shafts to their respective valves, slidewires 8, 9. The motors 6, 7 are connected to a computing device in the form of a microprocessor 10 via respective motor control logic units 11 and 12, the microprocessor 10 having an associated memory device 13 having both a read-only and read-write capability. The microprocessor 10 is fed with signals from an analog digital converter 14 itself preceded by a multiplexer 15. Associated with the burner 1 is a detector 16, the output from the detector 16 along with the outputs from the slidewires 8 and 9 being connected to the microprocessor via the multiplexer 15 and analog digital converter 14. An output port on the microprocessor 10 is connected to the multiplexer 15 and whereby the microprocessor can signal the multiplexer to select which of the incoming signals is to be scanned and compared with the data in the memory 13.

The microprocessor has additional output ports such as to provide information to a local control panel 17 where various indicators can be provided to show the positions of the fuel and air valves with further indicators to show the status of the slidewire and the status of the flame. Also on the local control panel can be provided a start button and an emergency cut-off with, if required, switch means to put the control means of the invention on to automatic operation or on to a hold-/manual condition. The microprocessor can have still further output ports, e.g., to supply information to a remote monitoring system 18 which can have its own memory device 19, of the electrically non-volatile type which will not erase the data in the memory in the event of the removal of electrical stimulation or excitation. A still further output port on the microprocessor is connected a diagnostic system 20 which can be used for both fault diagnosis and for setting up.

Prior to lighting the burner for the first time, the nature of the flame required at the burner for a pre-determined boiler output is calculated on a theoretical basis, and information concerning the required valve positions and a required value of a parameter of the flame placed in a data stack within the memory device 13. On firing the burner, with the automatic and simultaneous supply of electricity to the control means of the invention, information from the detector 16 concerning the selected flame parameter and a potential from each slidewire 8, 9 is fed to the multiplexer through the AD converter and to the microprocessor. The microprocessor then compares the signals that it is receiving, with the information in the memory device and if the pre-determined combustion conditions at the burner do not agree with the actual combustion conditions, the microprocessor signals the motors 6 and/or 7 via the motor control logics 11, 12 to increase or decrease the degree to which the valves 2 and/or 3 are open. The new positions of the valves are indicated by the slidewires and the new flame parameter provide further signals to the microprocessor which are again compared with the information in the memory. If the new signals show that the conditions within the burner more closely approach the pre-determined conditions then the motors are signalled by the microprocessor to continue their movement in the same direction. If the up-dated signals show that the conditions within the boiler have worsened on comparison with the information contained in the memory device then the microprocessor signals the motors to reverse and to cause movement of the valves in the opposite direction. This process is continued until the conditions at the burner are of closest approach to the pre-determined conditions initially fed to the memory device. During operation of the burner should any condition occur within a boiler or furnace in which the burner is situated or should there be any uncontrolled change in the supply conditions within the fuel and/or air lines, the microprocessor on receiving such signals, which do not compare with the data contained within the memory device, automatically signals an alteration in the position of the valves 2 and/or 3.

At the outset, therefore, the control means of the invention provides a means of automatically controlling the flame at a burner such that the burner has combustion conditions which are directly as have been pre-determined. However, it is inevitably so that the theoretical determination of the pre-determined combustion conditions is not necessarily accurate, and a required boiler output may not be satisfied by the pre-determined combustion conditions. Thus, with a demand parameter contained within the data stack in the memory device 13, there can be constant monitoring of the boiler performance and a comparison with the demand parameter. If a change is detected by the detector 16 in a flame parameter, and the comparison made by the microprocessor with the data in the stack in the memory device 13 shows that the particular valve positions providing the parameter detected by the detector 16 are better than the pre-determined parameters within the stack, then the information in the data stack can be up-dated so that after a reasonable short period of time, the data stack can be provided with optimum parameters concerning the fuel valve and air valve positions and the particular parameter of the flame being detected by the detector 16.

All the information displayed at the local control panel 17 may be re-produced on the remote monitoring system 18. To guard against the power failure or other fault which has the effect of erasing the data from the memory device 13, a second memory device 19 associated with the remote monitoring system should be provided and in which all the data in the memory device 13 is duplicated. If there then should be an inadvertent erasing of the information from the memory 13, that information, on rectification of the particular fault, can be replaced from the memory device 19.

We claim:

1. Control means for the reactant flow ratio for at least one burner comprising separate valve means for the control of flow of fuel and of air to a burner, a variator associated with each valve for the setting of the position thereof, sensing means associated with each valve for the sensing of the position thereof, a memory device for holding data pertaining to the characteristics of the control means, said memory device having initially stored therein data representing a calculated parameter related to an optimum condition of combustion and data representing control information for the flow of fuel and air to the burner corresponding to said calculated optimum parameter, a computing device for controlling the variators to adjust the positions of said valves in accordance with the calculated data in the memory device, and detector means associated with the or each burner for the detection of the actual value of said parameter related to the optimum condition of combustion, both said sensing and detector means being connected to the memory device, said memory device further including means for continually and automatically up-dating said data stored in the memory to that data which is detected by said detector and sensing means only when the system achieves a condition of combustion which is an improvement over a previously determined optimum condition of combustion, such that the computing device automatically optimises the performance of the control means on the basis of the feedback of information from the said detector means and sensing means.

2. Control means as in claim 1, wherein a number of individually controlled burners are provided within a boiler or furnace, each burner having its own control means.

3. Control means as in claim 1, wherein a number of burners are provided within a boiler or furnace on a common ring mains, the control means controlling the supply of fuel and air to the ring mains.

4. Control means as in claim 1, wherein one computing device and one memory device separately controls a number of burners either within one boiler or within a number of boilers.

5. Control means as in claim 1 which further includes a monitor/display system which communicates with the or each individual controller so that the status of the or each individual controller can be displayed and monitored at a central point.

6. Control means as in claim 2, wherein each individual control means is completely autonomous in respect of its operating capability so that in the event of one controller failing the other controllers in the same system are not affected.

7. Control means as in claim 1, wherein the or each control means is so connected to the monitor/display system such that the or each control means is able to continue operating normally in the event of a fault occurring in the monitor/display system.

8. Control means as in claim 1, wherein the computing device is a microprocessor.

9. Control means as in claim 1, wherein the memory device is a memory device having a read-only and a read-write facility.

10. Control means as in claim 1, wherein signals are fed to the computing device via an analog digital converter preceded by a multiplexer.

11. Control means as in claim 1, wherein the variators to control the positions of the valves are electrically driven motors.

12. Control means as in claim 1, wherein the sensing means for sensing the position of each valve are slidewires associated with the variators.

13. Control means according to claim 1 wherein said memory device means for continually and automatically up-dating the data stored in said memory further includes means for making cyclic changes in the fuel air ratio after theoretical optimum condition is achieved, and said means monitoring the parameter of combustion to determine whether said change was advantageous or disadvantageous, such that if disadvantageous, no updating of the memory data is affected, however, if said change is advantageous said memory data is up-dated to correspond to the condition providing the advantageous change in the parameter of combustion.

* * * * *